US011391548B1

(12) United States Patent
Woitas

(10) Patent No.: US 11,391,548 B1
(45) Date of Patent: Jul. 19, 2022

(54) SHOOTING TARGET LIFTER

(71) Applicant: Robert Mark Woitas, Coon Rapids, MN (US)

(72) Inventor: Robert Mark Woitas, Coon Rapids, MN (US)

( * ) Notice: Subject to any disclaimer, the term of this patent is extended or adjusted under 35 U.S.C. 154(b) by 74 days.

(21) Appl. No.: 16/870,661

(22) Filed: May 8, 2020

Related U.S. Application Data

(60) Provisional application No. 62/983,668, filed on Feb. 29, 2020.

(51) Int. Cl.
*F41J 7/04* (2006.01)

(52) U.S. Cl.
CPC ..... *F41J 7/04* (2013.01)

(58) Field of Classification Search
CPC ..... F41J 7/04; F41J 7/06
See application file for complete search history.

(56) References Cited

U.S. PATENT DOCUMENTS 3,064,976 A * 11/1962 Kuhn ..... A63B 63/00 273/369
3,233,904 A * 2/1966 Gillam ..... F41J 7/04 273/371
3,614,102 A 10/1971 Nikoden, Sr.
4,540,182 A * 9/1985 Clement ..... F41J 7/04 273/391
4,732,394 A * 3/1988 Stein ..... F41J 7/04 273/391
4,911,453 A 3/1990 Essex et al.
5,232,227 A * 8/1993 Bateman ..... F41J 7/04 273/392
5,240,258 A * 8/1993 Bateman ..... F41J 7/04 273/392
5,403,017 A 4/1995 Doss, III et al.
5,603,505 A * 2/1997 Acock ..... F41J 7/06 273/391
6,325,376 B1 12/2001 Elliott et al.
6,776,418 B1 8/2004 Sovine et al.
(Continued)

OTHER PUBLICATIONS

Wikipedia, "Conformal coating", en.wikipedia.org/wiki/Conformal_coating, archived by the Internet Archive's Wayback Machine on Sep. 7, 2018 (Year: 2018).*
(Continued)

*Primary Examiner* — Laura Davison
(74) *Attorney, Agent, or Firm* — Lund IP, PLLC

(57) ABSTRACT

A shooting target lifter includes a projectile-resistant tubular housing configured for coupling to a base of a falling shooting target including a reusable shooting target rotatably connected to the base. A target lifter arm is rotatably connected to the tubular housing, and an actuator is within the tubular housing with a first end pivotably mounted to the tubular housing and a second end pivotably mounted to the target lifter arm. A free end of the target lifter arm is configured to lift the reusable shooting target from the down position to the upright position when the ram is extended from the retracted position to the extended position. The shooting target lifter further includes a controller within the tubular housing configured to, in response to a wireless signal, output a control signal to extend the ram to reset the reusable shooting target from a down position to an upright position.

24 Claims, 8 Drawing Sheets

(56) References Cited

U.S. PATENT DOCUMENTS

| | | | | |
|---|---|---|---|---|
| 7,052,012 | B2 | 5/2006 | Dehart | |
| 7,201,376 | B2 | 4/2007 | Kuosa | |
| 7,556,268 | B2 | 7/2009 | Bateman et al. | |
| 7,694,973 | B1 * | 4/2010 | Hofmeister | F41J 7/06 273/391 |
| 7,731,197 | B2 | 6/2010 | Stutz | |
| 7,815,192 | B1 | 10/2010 | Kreiman et al. | |
| 8,151,726 | B2 * | 4/2012 | Cossaboom | F41J 11/02 116/303 |
| 8,235,390 | B1 | 8/2012 | Spikes | |
| 8,684,361 | B2 | 4/2014 | Henson et al. | |
| 8,695,985 | B2 | 4/2014 | Potterfield et al. | |
| 8,770,358 | B2 * | 7/2014 | Nakajima | F16F 9/464 188/267.2 |
| 8,910,943 | B2 | 12/2014 | Lee | |
| 9,612,092 | B2 * | 4/2017 | Chester | F41J 7/04 |
| 9,784,538 | B2 | 10/2017 | Sovine et al. | |
| 10,295,314 | B2 | 5/2019 | Anderson | |
| 10,655,941 | B2 * | 5/2020 | Brockel | F41J 5/04 |
| 2006/0290063 | A1 | 12/2006 | Hagar | |
| 2006/0290064 | A1 | 12/2006 | Hagar | |
| 2008/0224410 | A1 | 9/2008 | Bengtsson et al. | |
| 2010/0032906 | A1 | 2/2010 | Wilcox | |
| 2016/0195369 | A1 * | 7/2016 | Perry | F41J 5/04 434/19 |

OTHER PUBLICATIONS

USPSA, USPSA Competition Rules, Jan. 2019, USPSA®/IPSC, Inc., Burlington, WA.

Double Alpha Steel Setter—IPSC Popper Automatic Lifter [online], [retrieved on Jan. 26, 2020]. Retrieved from the Internet: <URL: www.doublealpha.biz/us/daa-steel-setter>.

* cited by examiner

SHOOTING TARGET LIFTER

RELATED APPLICATION

This application claims the benefit of and priority to U.S. Provisional Application No. 62/983,668, filed Feb. 29, 2020, which is hereby incorporated by reference.

TECHNICAL FIELD

This disclosure relates to reuseable firearm targets.

BACKGROUND

Shooting targets for firearms, such as pistols and rifles, come in many forms. Some targets are made from disposable materials, such as paper, while other targets are meant to be shot repeatedly. Such reusable targets are often made of metal.

In some examples, reusable targets may be stationary where a hit is confirmed by a report (sound) of a bullet hitting the target. In other examples, reusable targets may move in response to a hit. Hanging targets that swing in response to a hit are one example; another example are spring loaded targets that fall in response to a hit before a spring returns the target to its original standing position. Other targets are designed to fall when hit, providing a satisfying and readily-verifiable confirmation of a successful shot. Falling targets, such as pepper popper falling targets, are often preferred in competition over other reusable targets to aid in scoring and target acquisition by removing hit targets from a shooter's view.

BRIEF SUMMARY

While falling targets provide advantages over other reusable targets, one disadvantage is that such targets need to be reset before being shot again. Resetting falling targets requires ensuring safety of the target range a process that can take many minutes. However, techniques disclosed herein include a remote-activated target lifter for resetting a falling target. Manually resetting a falling target generally requires first closing a shooting range to active fire and physically traveling to and from the target from the shooting line—often a distance of 100 yards or more. The use of remote-activated target lifters improves both the speed and safety of resetting falling targets.

In one example, this disclosure is directed to a shooting target lifter including a projectile-resistant tubular housing configured for coupling to a base of a falling shooting target, the falling shooting target including the base and a reusable shooting target rotatably connected to the base movable between an upright position and a down position, a target lifter arm rotatably connected to the tubular housing and an actuator with an actuator housing and a ram actuatable between a retracted position and an extended position relative the actuator housing. The actuator is within the tubular housing and includes a first end pivotably mounted to the tubular housing and a second end pivotably mounted to the target lifter arm, the second end extending beyond an open end of the tubular housing. A free end of the target lifter arm is configured to lift the reusable shooting target from the down position to the upright position when the ram is extended from the retracted position to the extended position. The shooting target lifter further includes a controller configured to, in response to a wireless signal, output a control signal to extend the ram to reset the reusable shooting target from the down position to the upright position. The controller is within the tubular housing.

In a further example, this disclosure is directed to a shooting target system including a remote with a user input and a transmitter configured to transmit a wireless signal in response to activation of the user input, and a falling shooting target. The falling shooting target includes a base, and a reusable shooting target rotatably connected to the base movable between an upright position and a down position. The shooting target system further includes a shooting target lifter including a projectile-resistant tubular housing coupled to the base, a target lifter arm rotatably connected to the tubular housing, and an actuator with an actuator housing and a ram actuatable between a retracted position and an extended position relative the actuator housing. The actuator is within the tubular housing and includes a first end pivotably mounted to the tubular housing and a second end pivotably mounted to the target lifter arm, the second end extending beyond an open end of the tubular housing. A free end of the target lifter arm is configured to lift the reusable shooting target from the down position to the upright position when the ram is extended from the retracted position to the extended position. The shooting target system further includes a controller configured to, in response to the wireless signal, output a control signal to extend the ram to reset the reusable shooting target from the down position to the upright position. The controller is within the tubular housing.

DETAILED DESCRIPTION

Figure 1:
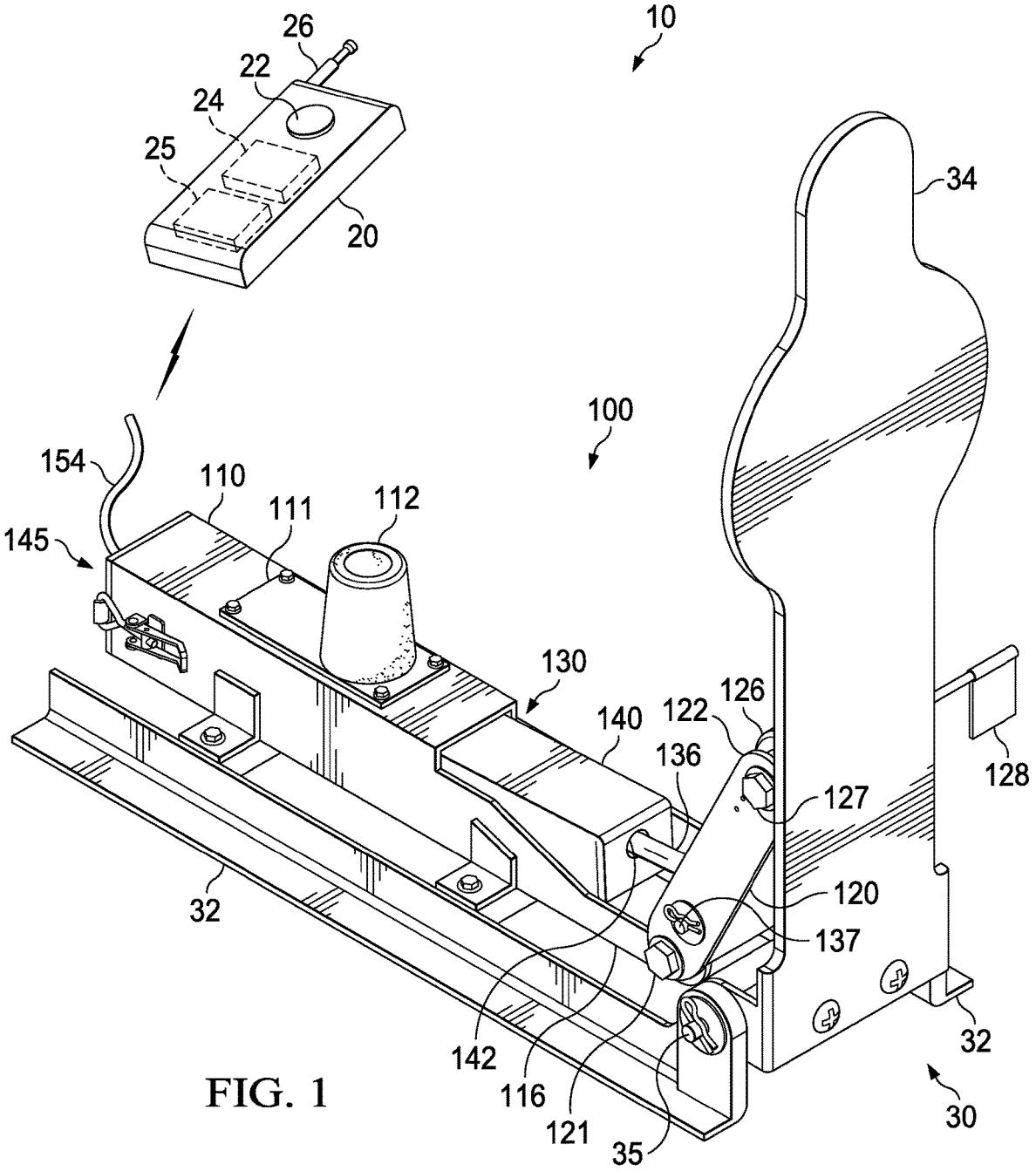
FIG. 1 illustrates a system including a falling shooting target, a shooting target lifter, and a wireless remote for activating the shooting target lifter.
Figure 2A:
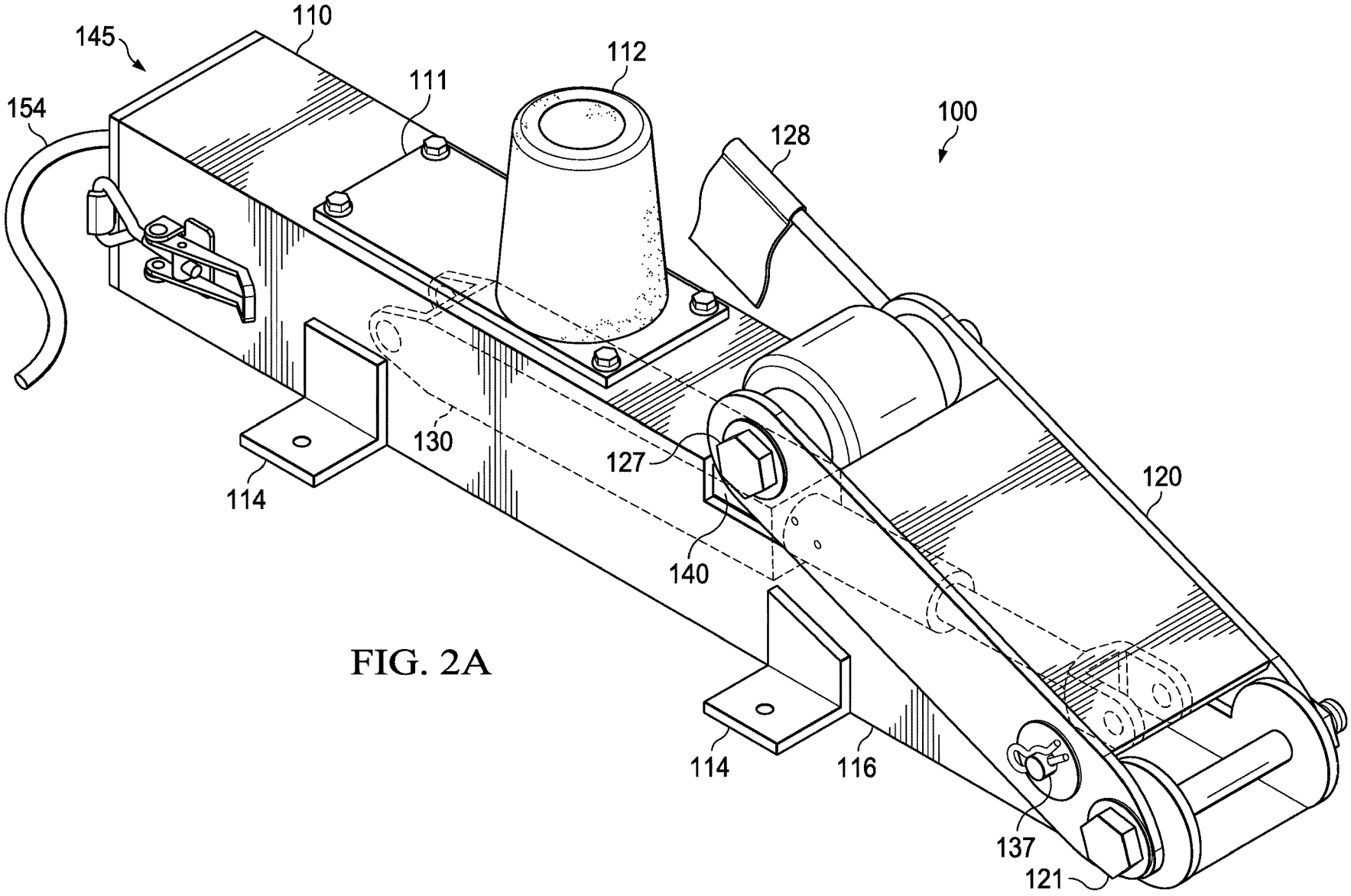
FIGS. 2A and 2B illustrate the shooting target lifter of FIG. 1.
Figure 2B:
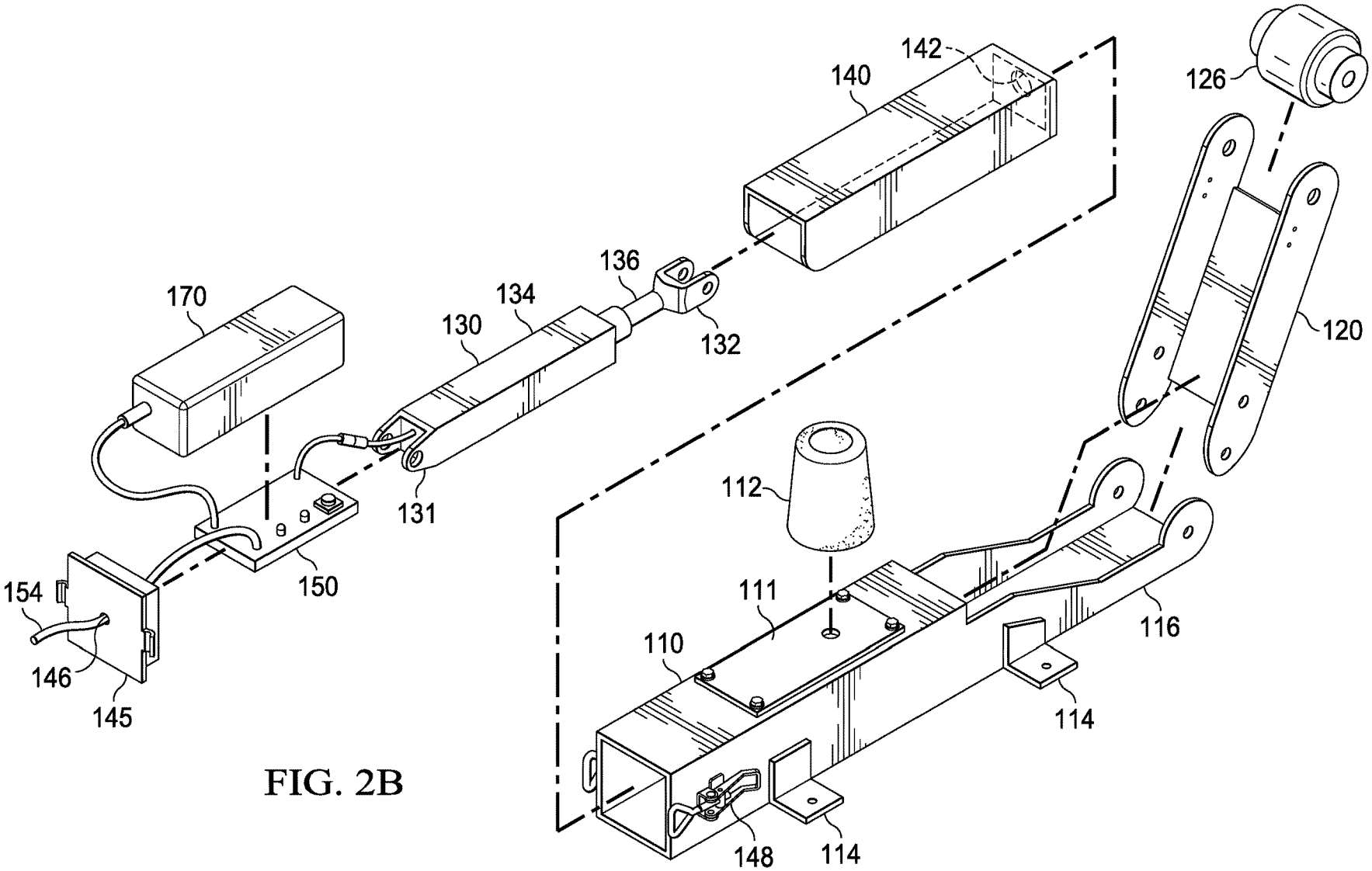

FIG. 1 illustrates a system 10 including a falling shooting target 30, a shooting target lifter 100, and a wireless remote 20 for activating shooting target lifter 100. FIGS. 2A and 2B illustrate shooting target lifter 100. More specifically, FIG. 2A is a perspective view of shooting target lifter 100, and FIG. 2B is an exploded view of shooting target lifter 100.

Shooting target system 10 includes a falling shooting target 30, and a shooting target lifter 100 configured to reset falling shooting target 30. Shooting target system 10 further includes a wireless remote 20 with a battery 25, a user input 22, and a transmitter 24 configured to, in response to activation of user input 22, transmit a wireless signal via antenna 26 configured to activate shooting target lifter 100 to reset falling shooting target 30 in response to activation of user input 22. In some examples, user input 22 may be a button or switch. In other examples, wireless remote 20 may be embodied as a personal electronic device, such as a smartphone, and user input 22 may be a touchscreen, voice activation, or other available user input to the personal electronic device.

While the techniques of this disclosure may be adapted to any wired or wireless communication medium, a wireless connection between wireless remote 20 and shooting target lifter 100 is preferred. In various examples, wireless remote 20 may operate using any variety of wireless communication, including long or short-range wireless connections, such as radio frequency (RF) transmissions, such as those within a frequency spectrum range between 300-450 MHz, Bluetooth, Wi-Fi, and/or cellular connections.

Falling shooting target 30 includes a base 32, and a reusable shooting target 34 rotatably connected to base 32 with pivot pin 35 and movable between an upright position and a down position about pivot pin 35. In some examples, reusable shooting target 34 represents a popper target, such as an International Practice Shooting Confederation (IPSC) standard popper target, IPSC mini popper target, a United States Practical Shooting Association (USPSA) standard popper target, or USPSA mini popper target. Reuseable popper targets are formed from a durable material such as ⅜ inch plate steel. These popper targets are fairly heavy with IPSC and USPSA mini popper targets generally weighing 20 to 30 pounds, and IPSC and USPSA standard popper targets generally weighing 50 to 70 pounds. Shooting target lifter 100 may be configured to reset any of these falling shooting targets, or other target configurations.

An IPSC standard popper target includes a flat profile with a round target of with a 15 centimeter (cm) radius on top of a base. The base has width of 20 cm at the round target and a bottom width of 15 cm. The center point of the round target is 70 cm above the bottom of the base. An IPSC mini popper target includes a round target of with a 10 cm radius on top of a base. The base has width of 13.5 cm at the round target and a bottom width of 10 cm. The center point of the round target is 46 cm above the bottom of the base. An IPSC mini popper target includes a flat profile with a round target of with a 10 cm radius on top of a base. The base has width of 13.5 cm at the round target and a bottom width of 10 cm. The center point of the round target is 46 cm above the bottom of the base.

USPSA standard and mini popper targets provide include flat profiles with similar shapes to the IPSC standard and mini popper targets with the addition of top target area above the round target. A USPSA standard popper target includes a flat profile with a round target of with a 6 inch radius on top of a base. The base has width of 8 inches at the round target and a bottom width of 6 inches. The center point of the round target is 27.38 inches above the bottom of the base. The top target area is centered above the round target with a circular portion with a 3 inch radius, the center point of the circular portion being 11.63 inches above the center point of the round target. Below the center point of the circular portion the top target area has a consistent width of 6 inches, matching the diameter of the circular portion of the top target area.

A USPSA mini popper target includes a flat profile with a round target of with a 4 inch radius on top of a base. The base has width of 5.38 inches at the round target and a bottom width of 4 inches. The center point of the round target is 18.25 inches above the bottom of the base. The top target area is centered above the round target with a circular portion with a 2 inch radius, the center point of the circular portion being 7.75 inches above the center point of the round target. Below the center point of the circular portion the top target area has a consistent width of 4 inches, matching the diameter of the circular portion of the top target area.

Shooting target lifter 100 includes a target lifter arm 120 rotatably connected to arms 116 of a projectile-resistant tubular housing 110. In the illustrated example, target lifter arm 120 is rotatably connected to holes in arms 116 of tubular housing 110 via bolt 121. Tubular housing 110 is coupled to base 32 of falling shooting target 30. In various examples, tubular housing 110 may be welded or bolted to base 32 via angle brackets 114. For example, angle brackets 114 may bolt directly to crossbeams of base 32. While non-adjustable angle brackets 114 are shown in the figures, in other examples, angle brackets may extend a length of tubular housing 110 and include multiple mounting holes to facilitate connections to falling shooting targets with a variety of dimensions.

As referred to herein, projectile-resistant means of durable construction sufficient to allow continued operation of the associated assembly following repeated impacts from bullets and bullet fragments discharged from firearms, such as handguns or rifles. In the preferred example, the projectile-resistant components are formed from metal, such as a steel alloy, with a thickness of at least ⅛ (0.125) inches, such as between ⅛ (0.125) inches and ½ (0.500) inches. Joints may be welded. In particular examples, projectile-resistant components are formed from 3/16 (0.188) inch steel. In some examples, such projectile-resistant components may be covered in a protective coating, such as paint, epoxy, or a layer applied through a chemical process, such as with galvanized steel or anodized aluminum. Depending on the severity of bullet impacts, the protective coating may be visibly or functionally degraded by the bullets in some examples.

An actuator 130 is within tubular housing 110 and includes a first end 131 pivotably mounted to tubular housing 110 and a second end 132 pivotably mounted to target lifter arm 120, second end 132 extending beyond an open end of tubular housing 110. Actuator 130 is configured to operate target lifter arm 120 through extension of ram 136 relative to actuator housing 134. Specifically, ram 136 is actuatable between a retracted position and an extended position relative to actuator housing 134 and acts on ram pivot pin 137, which is secured to target lifter arm 120 at a position offset from bolt 121. In some examples, actuator 130 may be an electronic actuator including an electric motor fixed relative to actuator housing 134, the motor turning a ball screw within actuator housing 134 to drive ram 136 relative to actuator housing 134.

A free end 122 of target lifter arm 120 is configured to lift reusable shooting target 34 from the down position to the upright position when the ram 136 is extended from the retracted position to the extended position. In the specific example shown, actuator housing 134 forms first end 131 pivotably mounted to tubular housing 110, and ram 136 forms second end 132 configured to lift reusable shooting target 34 from the down position to the upright position when ram 136 is extended from the retracted position to the extended position. In other examples, this orientation of actuator 130 may be reversed.

A roller 126 is coupled to free end 122 of target lifter arm 120, roller 126 being configured to roll over reusable shooting target 34 while target lifter arm 120 lifts reusable shooting target 34 from the down position to the upright position. Roller 126 is rotatably mounted to target lifter arm 120 by way of bolt 127. In some example, roller 126 may be a formed from a solid steel rod, such as a 2.5 inch solid steel rod with a drilled center hole to fit over bolt 127. In some examples, the center hole may be 0.5 inches in diameter. The solid steel construction of roller 126 provides impact resistance from bullets and bullet fragments.

A projectile-resistant actuator cover 140 is over a portion of actuator 130 and shields the open end of tubular housing 110. Actuator cover 140 is free to move with actuator 130 as actuator 130 pivots relative to tubular housing 110 while ram 136 actuates between the retracted position and the extended position. Actuator cover 140 includes a hole 142 through which ram 136 extends, a size of hole 142 being too small to allow actuator housing 134 to pass through hole 142. In some examples, the front of projectile-resistant actuator cover 140 with hole 142 may be formed by drilling, bending and welding a stock rectangle tube, such as a stock steel tube 2.5 inches by 2.0 inches.

Shooting target lifter 100 includes a number of electronic components that support the operation of actuator 130 to lift reusable shooting target 34 from the down position to the upright position. These electronic components include a controller 150, a battery 170 and actuator 130. Battery 170 powers controller 150, and at least in examples in which actuator 130 is an electric actuator, battery 170 also powers actuator 130. In other examples such as when actuator 130 is a pneumatic actuator, battery 170 may power pneumatic switches to activate actuator 130 by releasing gas from a pressure source. In such examples, the pressure source may include a tank within tubular housing 110 or may be outside tubular housing 110.

The electronic components of shooting target lifter 100, including controller 150, battery 170 and actuator 130, are protected within tubular housing 110. Actuator cover 140 partially shields the open end of tubular housing 110, and reusable shooting target 34 further covers the open end of tubular housing 110 when in the upright position, as shown in FIG. 1. Shooting target lifter 100 further includes a projectile-resistant back cap 145 covering an end of tubular housing 110 opposing the open end of tubular housing 110. Latch 148 releasably secures back cap 145 to the end of tubular housing 110 to allow easy access to controller 150 and battery 170. Antenna 154 extends from controller 150 and through an antenna hole 146 in back cap 145.

A bumper 112 is mounted on a top side of tubular housing 110, bumper 112 being configured to cushion reusable shooting target 34 when it falls between the upright position and the down position. In some examples, bumper 112 may be a solid rubber bumper. Bumper 112 is attached to top cover 111 of tubular housing 110. In some examples, bumper 112 may be attached to top cover 111 by way of a bolt through tubular housing 110 while top cover 111 is attached to tubular housing 110 by way of screws, such as self-tapping screws.

Shooting target lifter 100 further includes an optional flag 128 that moves in unison with target lifter arm 120. Flag 128 is visible adjacent reusable shooting target 34 when ram 136 is in the extended position and flag 128 is lowered with ram 136 is in the retracted position. The presence of flag 128 allows a shooter to wait for target lifter arm 120 to move to the lowered position before firing in order to allow reusable shooting target 34 to fall upon impact.

Controller 150 is configured to, in response to a wireless signal from wireless remote 20, output a control signal to actuator 130 to extend ram 136 to reset reusable shooting target 34 from the down position to the upright position. In some examples, controller 150 is further configured to, in response to the wireless signal, after extending ram 136 to reset reusable shooting target 34 from the down position to the upright position, pause ram 136 for at least 1 second in the extended position, and retract ram 136 to the retracted position. The pause may allow reusable shooting target 34 to sway in the upright position without falling immediately after being lifted by shooting target lifter 100.

Figure 3:
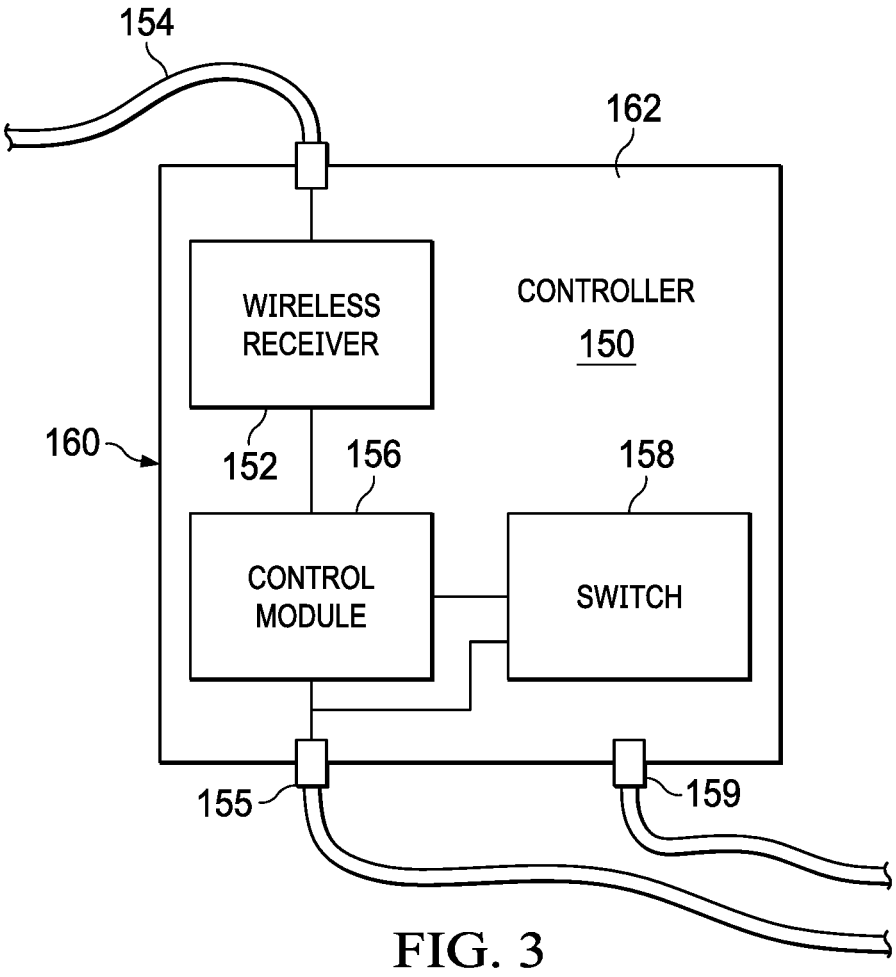
FIG. 3 is a conceptual block diagram of a controller of the shooting target lifter of FIG. 1.

FIG. 3 is a conceptual block diagram of controller 150. In the specific example illustrated in FIG. 3, controller 150 includes a wireless receiver 152, a control module 156, and a switch 158 encased within a polymer 162 that protects wireless receiver 152, control module 156, and switch 158 from an external environment. Wireless receiver 152 is operable to receive wireless signals from wireless remote 20 via antenna 154 and relay the wireless signals to control module 156. In turn, control module 156 is operable to activate switch 158. Switch 158 controls actuator 130 via switch output 159. In some examples, switch 158 may include a low power input from control module 156 to control the switch position (off, on, or on-reverse polarity) and a power connection 155 to battery 170 used drive actuator 130. Switch 158 may further be configured to reverse polarity to actuator 130 in order to retract actuator 130.

The electronic components of controller 150, such as wireless receiver 152, control module 156, and switch 158, are encased within a polymer 162 that protects electronic components from an external environment. In some examples, polymer 162 may be an epoxy polymer applied to controller housing 160 as a liquid precursor prior to curing. In such examples, the cured epoxy polymer may serve to limit moisture intrusion into the components of controller 150, as well as mitigate vibrations that may damage electrical connections between the components of controller 150. For example, solder connections may be susceptible to fracture, such as impact fracture or fatigue fracture caused by shooting projectiles or projectile fragments impacting reusable shooting target 34 and other components of falling shooting target 30 and shooting target lifter 100. By covering the components of controller 150, polymer 162 serves to both shield the components from moisture and to limit the relative movement of the components that could lead to impact or fatigue failure of electrical conductors including solder joints.

Figure 4A:
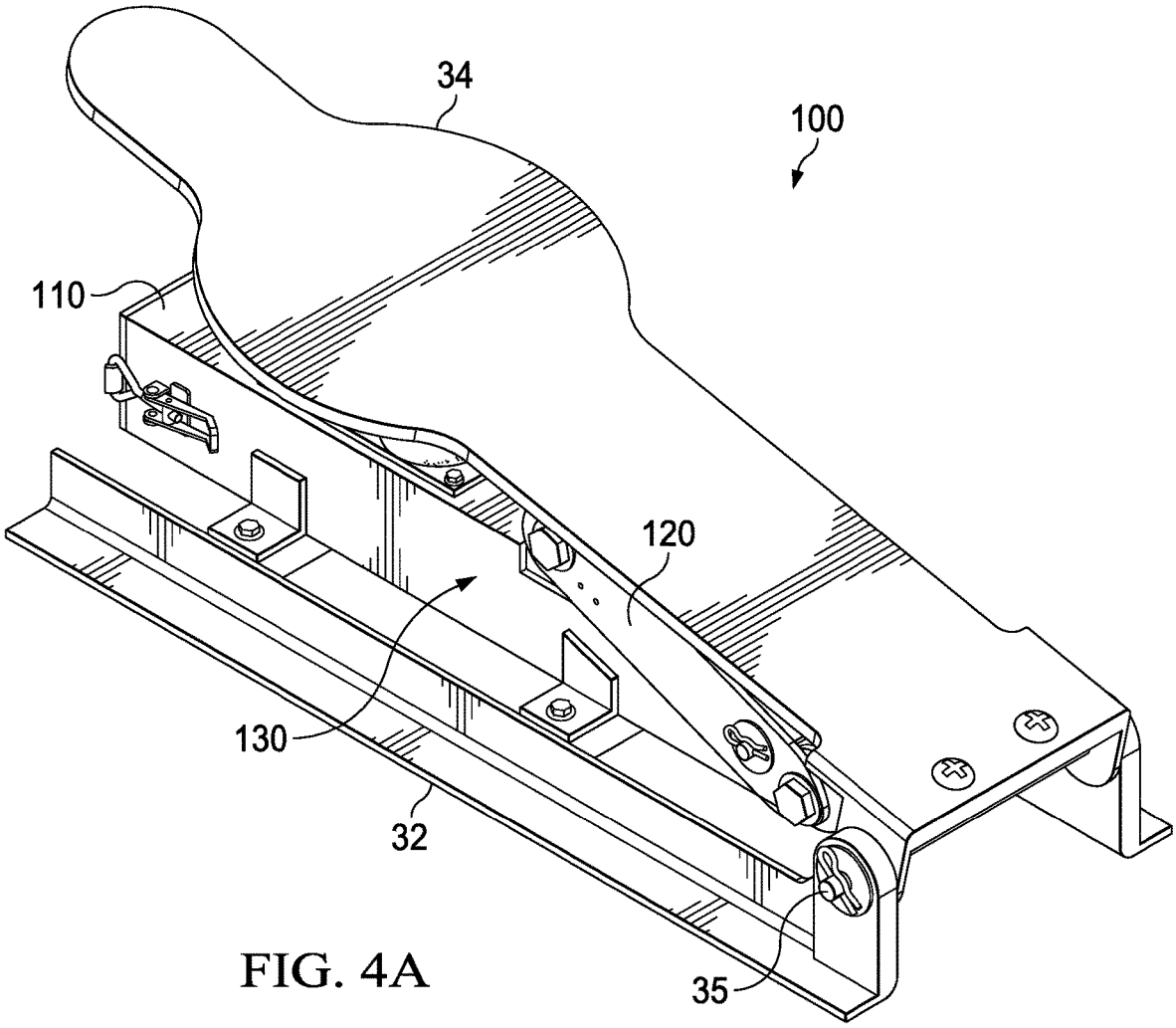
FIGS. 4A-4D illustrate the shooting target lifter of FIG. 1 as it resets the falling shooting target of FIG. 1.

FIGS. 4A-4D illustrate shooting target lifter 100 as it resets the falling shooting target 30 of system 10. As shown in FIG. 4A, reusable shooting target 34 is in the down position relative to base 32. Target lifter arm 120 is in the collapsed position with ram 136 retracted relative to actuator housing 134. Reusable shooting target 34 is resting against bumper 112 on top cover 111 of tubular housing 110.

Figure 4B:
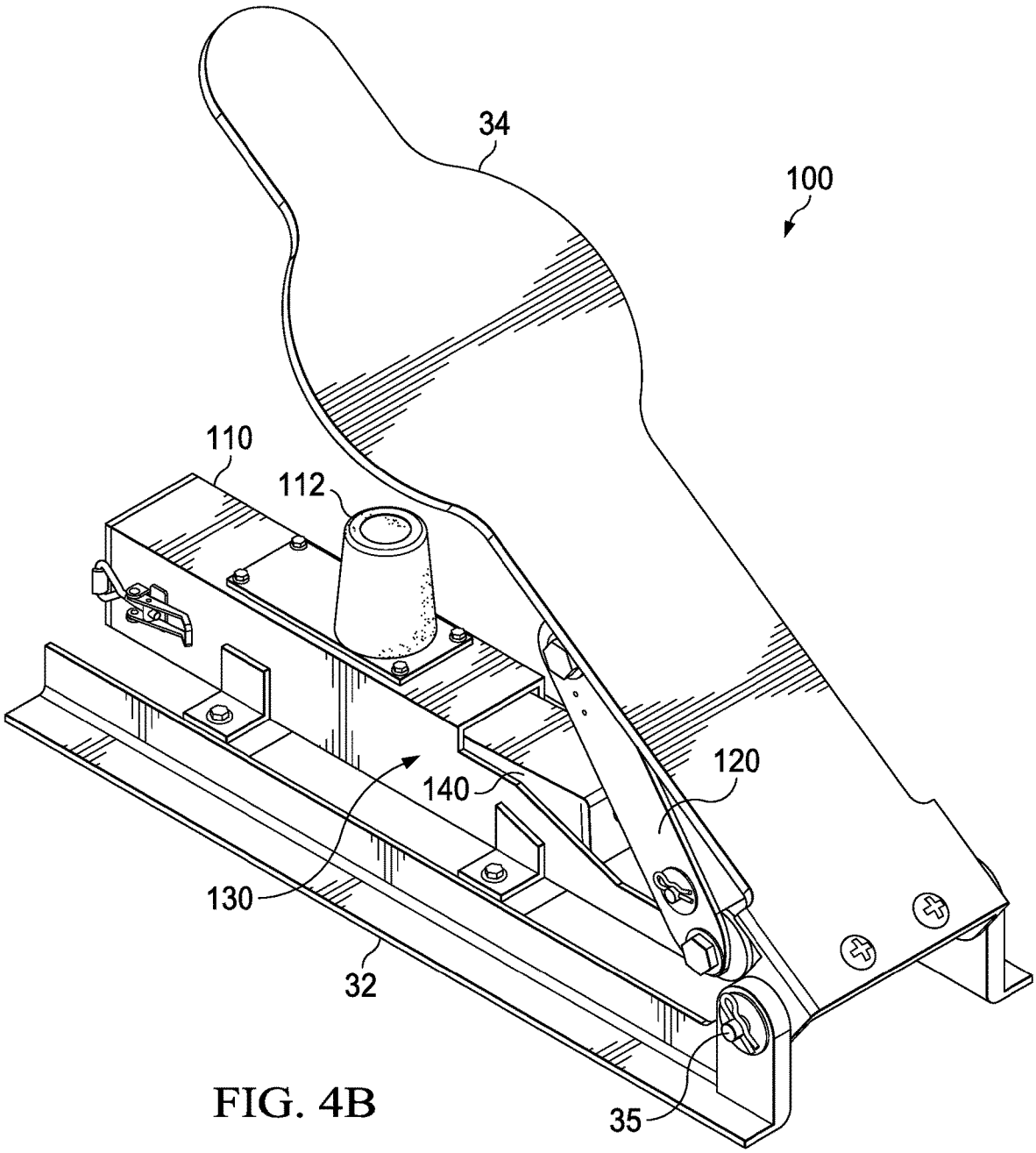

As shown in FIG. 4B, shooting target lifter 100 has been activated by way of a user input via wireless remote 20 (FIG. 1). Controller 150 has activated actuator 130, extending ram 136 relative to actuator housing 134, thereby rotating target lifter arm 120 relative to tubular housing 110. Reusable shooting target 34 is being lifted by target lifter arm 120 with roller 126 rotating on bolt 127 while rolling against reusable shooting target 34.

Figure 4C:
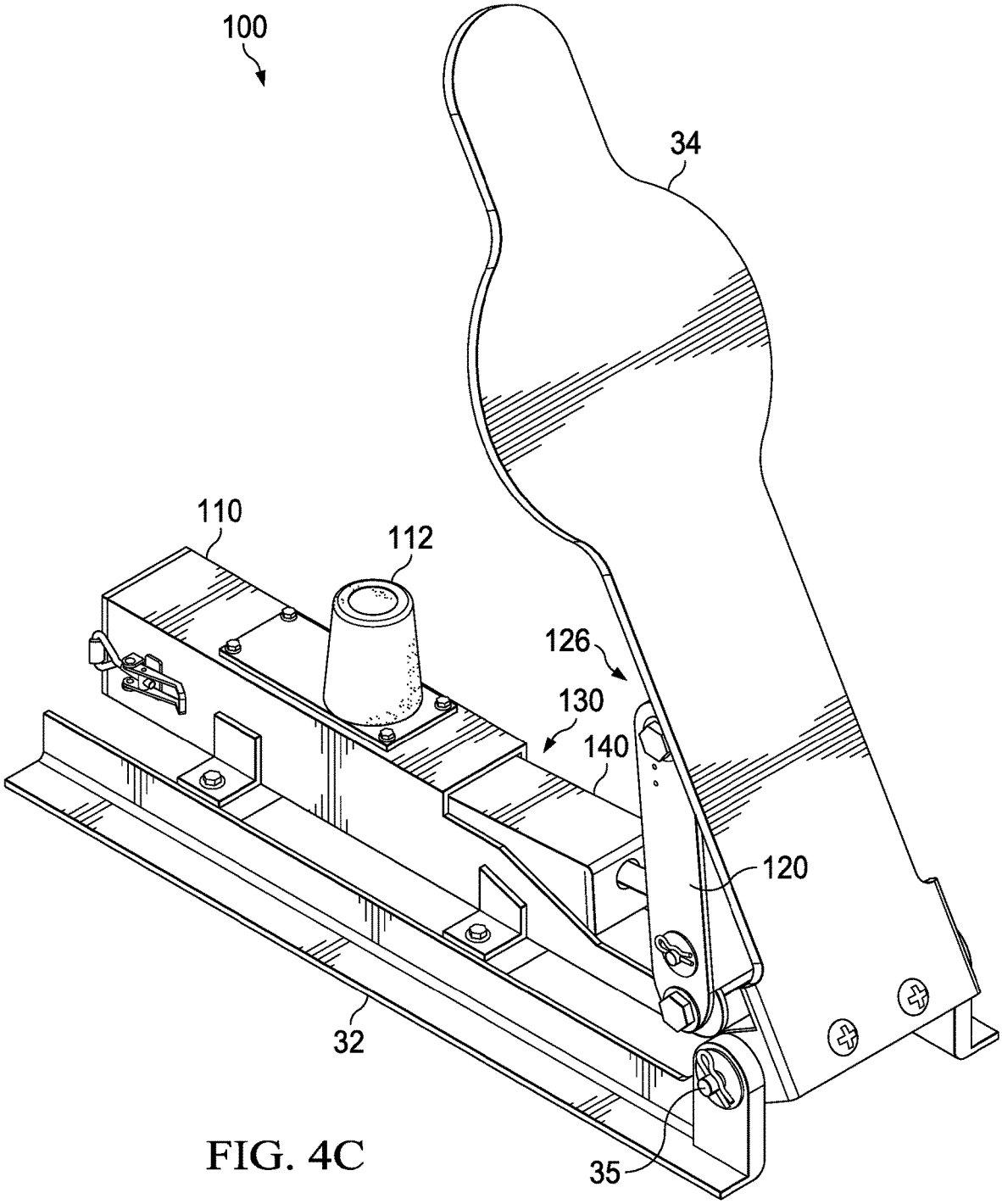

As shown in FIG. 4C, shooting target lifter 100 continues to lift reusable shooting target 34 from the down position to the upright position. Compared to FIG. 4B, ram 136 is further extended relative to actuator housing 134, and target lifter arm 120 is further rotated relative to tubular housing 110. Reusable shooting target 34 continues to be lifted by target lifter arm 120 with roller 126 acting against reusable shooting target 34.

One advantage of the configuration of shooting target lifter 100 is that target lifter arm 120 provides the most mechanical advantage against the weight of reusable shooting target 34 in the down position. When in the down position, much of the weight of reusable shooting target 34 is against roller 126, but roller 126 is positioned the furthest from pivot pin 35, thus limiting the force required by actuator 130 to lift reusable shooting target 34. As target lifter arm 120 lifts reusable shooting target 34 progressively more upright, greater proportions of the weight of reusable shooting target 34 are born by pivot pin 35, lowering the lifting force. However, roller 126 moves closer to pivot pin 35, thereby decreasing the mechanical advantage while increasing lifting speed. Thus, the configuration provided by the design of shooting target lifter 100 facilitates a limited ram force required by actuator 130 with an increased lifting speed as reusable shooting target 34 pivots upright on pivot pin 35.

Figure 4D:
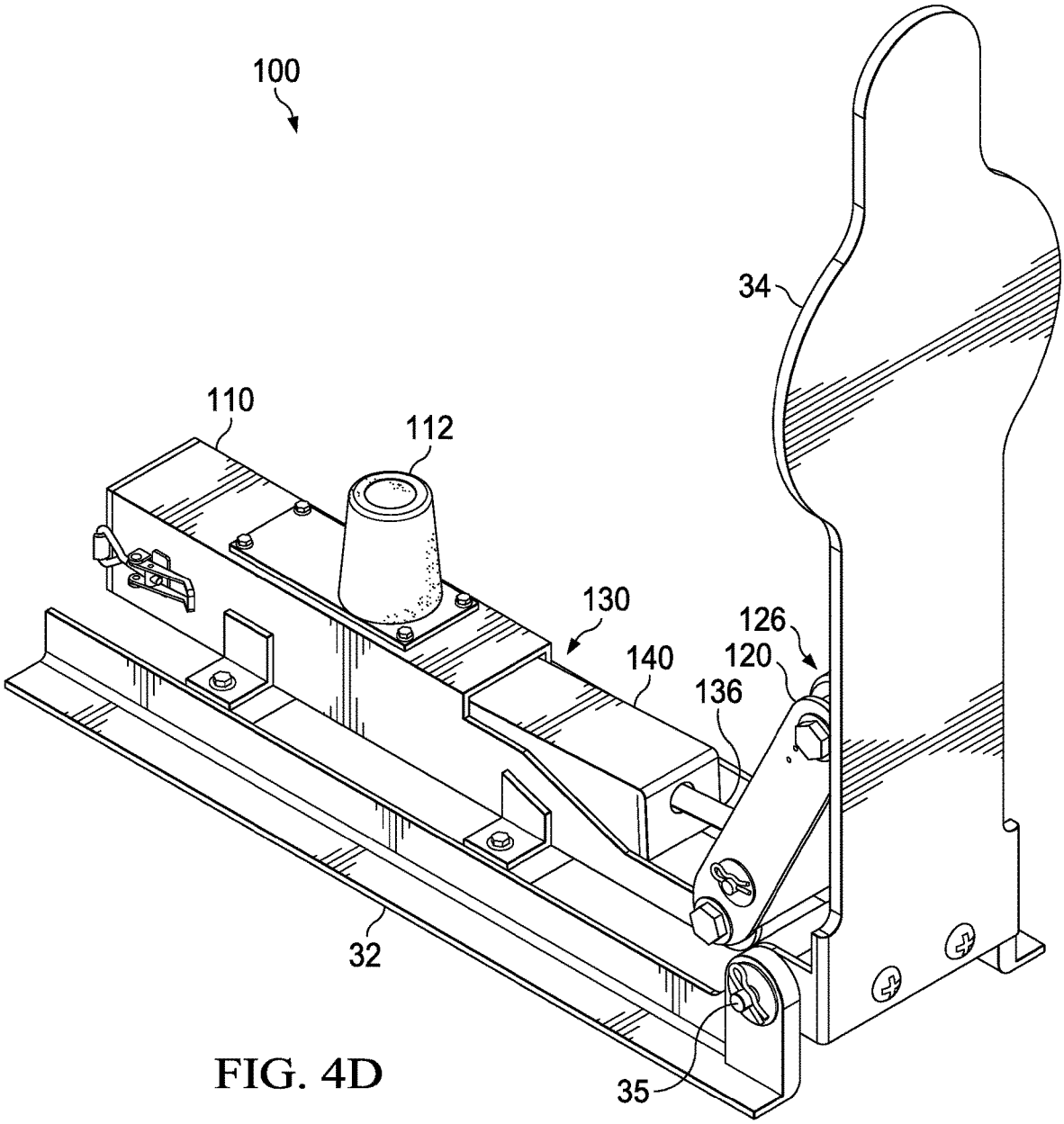

As shown in FIG. 4D, shooting target lifter 100 has finished lifting reusable shooting target 34 to the upright position. Compared to FIG. 4C, ram 136 is further extended relative to actuator housing 134, and target lifter arm 120 is further rotated relative to tubular housing 110. Roller 126 continues to press against reusable shooting target 34, but reusable shooting target 34 has reached the stop that limits its rotation relative to base 32. In some examples, controller 150 may pause ram 136 in the position shown in FIG. 4D before retracting to allow reusable shooting target 34 to freefall upon impact. The pause may allow reusable shooting target 34 to sway in the upright position without falling immediately after being lifted by shooting target lifter 100.

The specific techniques resetting a falling shooting target, such as techniques embodied by shooting target lifter 100, are merely illustrative of the general inventive concepts included in this disclosure as defined by the following claims.

The invention claimed is:

1. A shooting target lifter comprising:

a projectile-resistant tubular housing configured for coupling an external surface of the tubular housing to a base of a falling shooting target, the falling shooting target including the base and a reusable shooting target rotatably connected to the base movable between an upright position and a down position;

a target lifter arm rotatably connected to the tubular housing;

an actuator with an actuator housing and a ram actuatable between a retracted position and an extended position relative the actuator housing, wherein the actuator is within the tubular housing and includes a first end pivotably mounted to the tubular housing and a second end pivotably mounted to the target lifter arm, the second end extending beyond an open front end of the tubular housing forming an opening in a front side of the tubular housing, wherein a free end of the target lifter arm is configured to lift the reusable shooting target from the down position to the upright position when the ram is extended from the retracted position to the extended position; and a controller configured to, in response to a wireless signal, output a control signal to extend the ram to reset the reusable shooting target from the down position to the upright position, wherein the controller is within the tubular housing.

2. The shooting target lifter of claim 1, further comprising a battery that powers the controller, wherein the battery is within the tubular housing.

3. The shooting target lifter of claim 2, wherein the actuator is an electric actuator, wherein the battery powers the electric actuator.

4. The shooting target lifter of claim 1, further comprising a projectile-resistant actuator cover over a portion of the actuator and shielding the open front end of the tubular housing, wherein actuator cover is free to move with the actuator as the actuator pivots relative to the tubular housing while the ram actuates between the retracted position and the extended position.

5. The shooting target lifter of claim 4, wherein the actuator cover includes a hole through which the ram extends, a size of the hole being too small to allow the actuator housing to pass through the hole.

6. The shooting target lifter of claim 1, wherein the controller includes a wireless receiver, a control module, and a switch encased within a polymer that protects the wireless receiver, the control module, and the switch from an external environment.

7. The shooting target lifter of claim 1, further comprising a projectile-resistant back cap covering a back end of the tubular housing opposing the open front end of the tubular housing.

8. The shooting target lifter of claim 7, further comprising an antenna extending from the controller and through an antenna hole in the back cap.

9. The shooting target lifter of claim 1, further comprising a roller coupled to the free end of the target lifter arm, the roller being configured to roll over the reusable shooting target while the target lifter arm lifts the reusable shooting target from the down position to the upright position.

10. The shooting target lifter of claim 1, further comprising a bumper on a top side of the tubular housing, the bumper being configured to cushion the reusable shooting target when it falls between the upright position and the down position.

11. The shooting target lifter of claim 1, further comprising a flag that moves in unison with the target lifter arm such that the flag is visible adjacent the reusable shooting target when the ram is in the extended position and the flag is lowered with the ram is in the retracted position.

12. The shooting target lifter of claim 1, wherein the actuator housing forms the first end pivotably mounted to the tubular housing, and wherein the ram forms the second end configured to lift the reusable shooting target from the down position to the upright position when the ram is extended from the retracted position to the extended position.

13. The shooting target lifter of claim 1, wherein the controller is further configured to, in response to the wireless signal, after extending the ram to reset the reusable shooting target from the down position to the upright position, pause the ram for at least 1 second in the extended position before retracting the ram to the retracted position.

14. The shooting target lifter of claim 1, wherein the opening of the open front end of the tubular housing is a contiguous opening including the front side of the tubular housing and a front portion of a top side of the tubular housing.

15. A shooting target system comprising:

a remote with a user input and a transmitter configured to transmit a wireless signal in response to activation of the user input;

a falling shooting target including:

a base; and a reusable shooting target rotatably connected to the base movable between an upright position and a down position; and a shooting target lifter including:

a projectile-resistant tubular housing with an external surface of the tubular housing coupled to the base;

a target lifter arm rotatably connected to the tubular housing;

an actuator with an actuator housing and a ram actuatable between a retracted position and an extended position relative the actuator housing, wherein the actuator is within the tubular housing and includes a first end pivotably mounted to the tubular housing and a second end pivotably mounted to the target lifter arm, the second end extending beyond an open front end of the tubular housing forming an opening in a front side of the tubular housing, wherein a free end of the target lifter arm is configured to lift the reusable shooting target from the down position to the upright position when the ram is extended from the retracted position to the extended position; and a controller configured to, in response to the wireless signal, output a control signal to extend the ram to reset the reusable shooting target from the down position to the upright position, wherein the controller is within the tubular housing.

16. The shooting target system of claim 15, wherein the actuator is an electric actuator, the system further comprising a battery that powers the controller and the electric actuator, wherein the battery is within tubular housing.

17. The shooting target system of claim 15, further comprising a projectile-resistant actuator cover over a portion of the actuator and shielding the open front end of the tubular housing, wherein the actuator cover is free to move with the actuator as the actuator pivots relative to the tubular housing while the ram actuates between the retracted position and the extended position.

18. The shooting target system of claim 15, wherein the controller includes a wireless receiver, a control module, and a switch encased within a polymer that protects the wireless receiver, the control module, and the switch from an external environment.

19. The shooting target system of claim 15, further comprising a roller coupled to the free end of the target lifter arm, the roller being configured to roll over the reusable shooting target while the target lifter arm lifts the reusable shooting target from the down position to the upright position.

20. The shooting target system of claim 15, further comprising a flag that moves in unison with the target lifter arm such that the flag is visible adjacent the reusable shooting target when the ram is in the extended position and the flag is lowered with the ram is in the retracted position.

21. The shooting target system of claim 15, wherein the controller is further configured to, in response to the wireless signal, after extending the ram to reset the reusable shooting target from the down position to the upright position, pause the ram for at least 1 second in the extended position, and retract the ram to the retracted position.

22. The shooting target system of claim 15, further comprising:

a target pivot pin rotatably connecting the reusable shooting target to the base; and a lifter arm pin rotatably connecting the target lifter arm to the tubular housing.

23. The shooting target system of claim 15, wherein the opening of the open front end of the tubular housing is a contiguous opening including the front side of the tubular housing and a front portion of a top side of the tubular housing.

24. The shooting target system of claim 15, wherein the base of the falling shooting target includes crossbeams, and wherein the external surface of the tubular housing is coupled to the crossbeams.

* * * * *